United States Patent [19]

Bambozzi

[11] 4,347,489

[45] Aug. 31, 1982

[54] VARIABLE THREE-PHASE INDUCTOR

[76] Inventor: Bruno Bambozzi, 856 Jose Bonifacio Str., Matao, SP, Brazil

[21] Appl. No.: 205,965

[22] Filed: Nov. 12, 1980

[51] Int. Cl.[3] ..... H01F 33/00; H01F 21/06

[52] U.S. Cl. ..... 336/10; 336/132; 336/136

[58] Field of Search ..... 336/5, 10, 12, 130, 336/132, 133, 134, 135, 136

[56] References Cited

U.S. PATENT DOCUMENTS 2,488,734 11/1949 Mueller ..... 336/135

3,375,421 3/1968 Venard ..... 336/135 X

*Primary Examiner*—Thomas J. Kozma

*Attorney, Agent, or Firm*—Michael J. Striker

[57] ABSTRACT

A three-phase variable inductor is disclosed in which a fixed frame is formed by a plurality of laminar plates, the plates being rotated with respect to each other about a common axis. Within the frame, a Y network is located, the Y network being so constructed that the magnetic fields generated thereby during operation cancel out in the radial direction to prevent any net radial force from being exerted against a laminar movable reluctor that can be moved into and out of the frame and Y network. As a result of this construction, vibration is eliminated. Both the frame and the movable reluctor are made of iron and silicon, which reduced heat generation and increases efficiency.

8 Claims, 6 Drawing Figures

FIG. 3
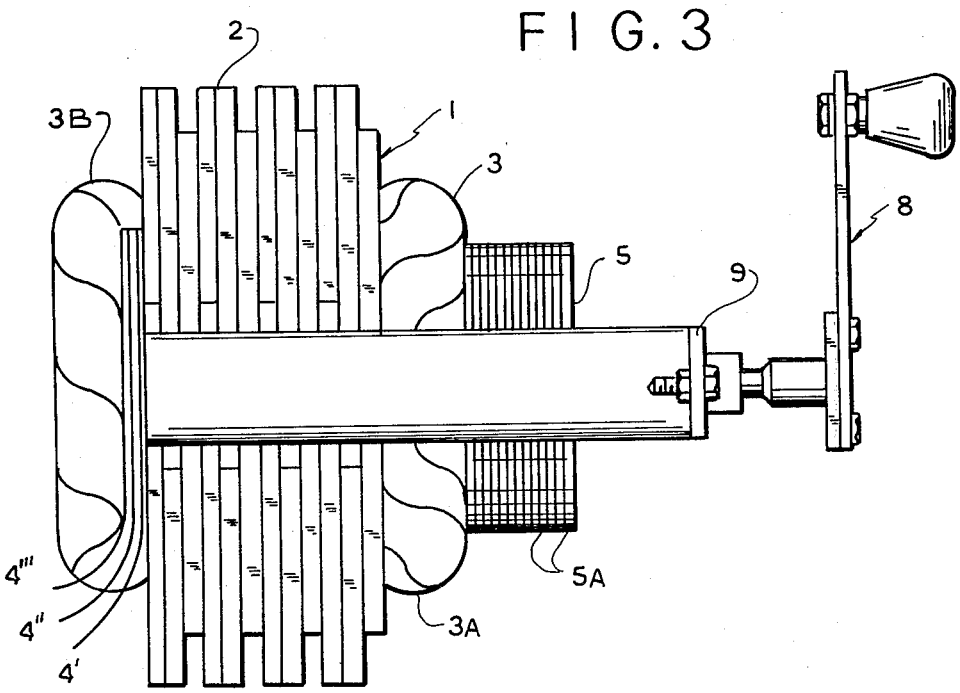
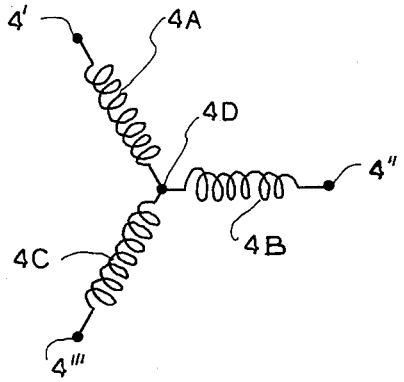
FIG. 4

COIL 4A - - - - - - - - - - - -

COIL 4B -——-——-——-

COIL 4C ————————————

VARIABLE THREE-PHASE INDUCTOR

BACKGROUND OF THE INVENTION

1. Field of the Invention

This invention pertains to variable inductors. More particularly, this invention pertains to variable inductors designed for use with three-phase AC sources.

2. Description of the Prior Art

Conventionally, three-phase variable inductors (which are also known as reactors) have certain disadvantages. First, prior-art devices develop large amounts of heat because of losses in components having a high magnetic resistivity. While such development of heat is undesirable in and of itself, it has the further disadvantage of reducing the efficiency of the device.

Second, conventional prior-art devices may vibrate appreciably during operation, especially in the case of devices which are designed for use at high currents. In the prior art it is necessary to damp such vibration by using mechanical techniques such as immersion in dense liquids and the like.

Therefore, it would be advantageous to provide a variable inductor suitable for use with three-phase AC sources which would produce less heat and thereby be more efficient and which would also not vibrate during operation.

SUMMARY OF THE INVENTION

These objects, along with others which will become apparent hereinafter, are achieved in this invention by designing a variable inductor in such a fashion that magnetic forces acting upon the movable reluctor always cancel out to zero in the radial direction. As a result of this feature, radial vibration of the movable reluctor is prevented. While magnetic forces will exist in the axial direction along which the reluctor may be moved, these forces will not cause vibration because the reluctor is positively fixed in the axial direction and can only move when a user wishes to vary the inductance of the device.

Furthermore, both the reluctor itself and the frame in which the windings of the invention are disposed can be manufactured in a laminar fashion of a magnetic substance which includes iron and silicon. Because this substance has a low magnetic resistivity, heat generation is minimized and the efficiency of the device is correspondingly increased. Advantageously, the frame may be formed by a plurality of like square plates which are rotated with respect to each other in a single direction about the axis of the device. As a result of this construction, more surface area is exposed so that any heat generated during operation can be more efficiently dissapated. As a result, heat buildup is further reduced.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTION OF THE DRAWINGS

FIG. 3 shows a plan view of the invention in a fashion similar to that shown in FIG. 2;

FIG. 4 is a schematic diagram showing the connection of the windings used in the invention;

DETAILED DESCRIPTION OF THE PREFERRED EMBODIMENTS

Figure 1:
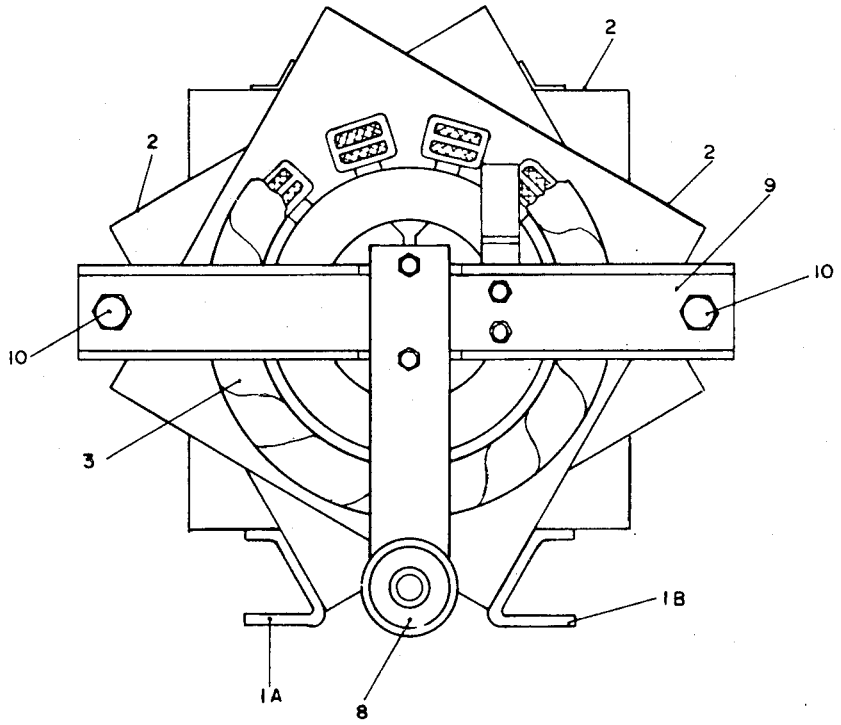
FIG. 1 shows a front view of the invention, partially in section.
Figure 5:
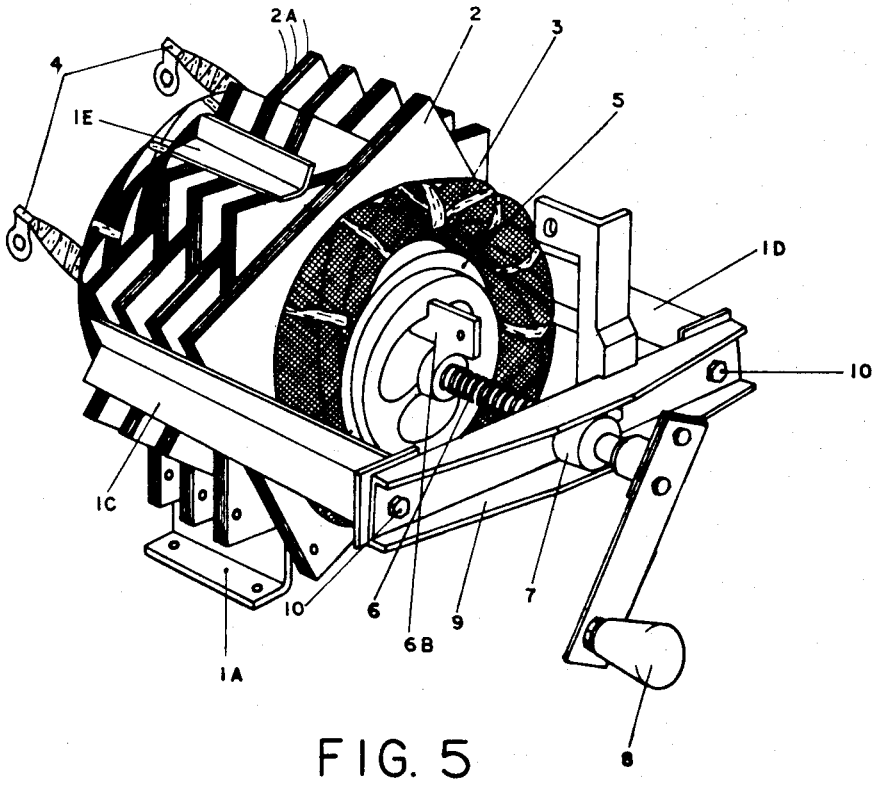
FIG. 5 is a perspective drawing of the invention.

Referring first to FIGS. 1 and 5 together, it can be seen that a frame generally indicated by reference numeral 1 can be fixed to a horizontal surface by means of bottom brackets 1A and 1B. Side brackets 1C and 1D and, optionally, one or more top bracket 1E can be used to hold frame 1 together and to prevent it from separating into laminar sheets as will be later described.

Frame 1 is constructed of a plurality of like square plates 2, each plate 2 being laminar and including a plurality of like square sheets 2A. Each sheet 2A is approximately 230 mm on a side and is manufactured of a magnetic material which includes iron and silicon. Each of sheets 2A within a given plate 2 are aligned with each other, and plates 2 are rotated 30° of arc with respect to each other in a single direction about a common axis 11 which runs through the center of the device.

Each of sheets 2A has a central hole which is approximately 150 mm in diameter, defining a hollow cylindrical interior volume extending axially through frame 1. A first coil 4A, a second coil 4B and a third coil 4C (shown schematically in FIG. 4) are all connected at one end to a common point 4D to form a Y network having input terminals 4', 4'', and 4'''. Hence, terminal 4' indicates the input terminal to first coil 4A, terminal 4'' indicates the input terminal to the second coil 4B, and terminal 4''' indicates the input terminal for third coil 4C. These coils 4A, 4B and 4C are shaped into a hollow, elongated and generally cylindrical structure 3 which extends into the interior volume defined by the holes in sheets 2A in frame 1. Although front end 3A and rear end 3B of structure 3 protrude radially outwardly from frame 1, structure 3 is internally cylindrical and coaxial with axis 11. The location of coils 4A, 4B, and 4C within structure 3 will be discussed below.

Figure 2:
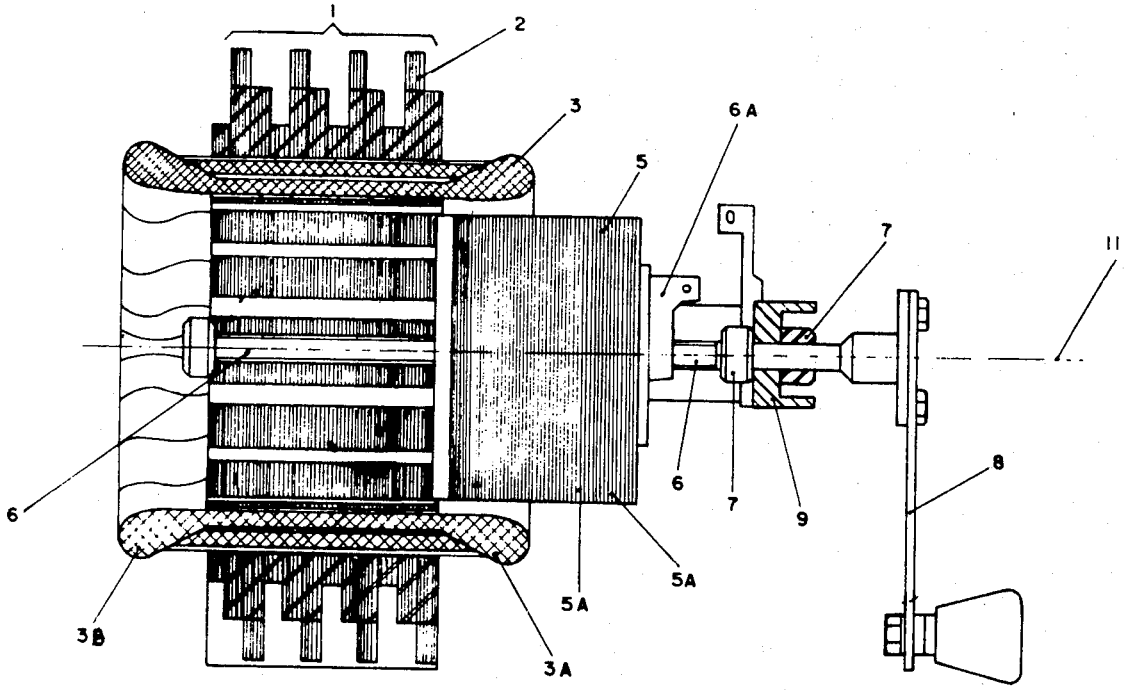
FIG. 2 shows a side view of the invention, partially in cross-section.

Cross bar 9 is attached at one end to side bracket 1C by bolt 10, and is similarly attached at its other end to side bracket 1D. Cross bar 9 supports two bearings 7 which, as can be seen most clearly in FIG. 2, are aligned with common axis 11. Bearings 7 support a threaded rotatable shaft 6 which extends along common axis 11 and can be rotated thereabout by crank handle 8.

Threaded shaft 6 threadedly engages movable reluctor 5. Movable reluctor 5, like frame 1 and plates 2, is laminar and includes a plurality of like annular discs 5A which are all aligned with each other to form a hollow cylinder. Annular discs 5A are, like sheets 2A, made of iron and silicon and are so dimensioned that the distance between their radially outermost edges and structure 3 is approximately 0.5 mm. Since threaded shaft 6 threadedly engages movable reluctor 5, movable reluctor 5 will be moved axially inwardly and outwardly along common axis 11 when crank handle 8 is rotated by a user.

Figure 6:
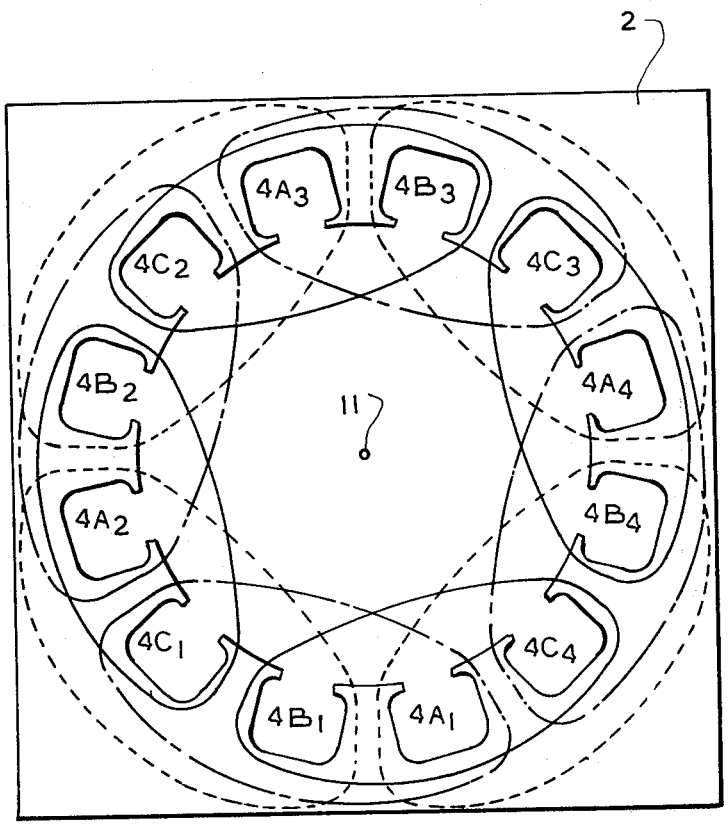
FIG. 6 is a diagram showing the magnetic field lines developed inside the invention during operation.

Turning now to FIGS. 1 and 6, it can be seen that each of coils 4A, 4B and 4C have four separate coil sections. In FIG. 6, each coil section is indicated by a subscript which is associated with an alphanumeric prefix indicating the coil to which the coil section pertains. Thus, $4A_1$ indicates the first coil section in coil 4A, $4B_2$ indicates the second coil section in coil 4B, and $4C_3$ indicates the third coil section in coil 4C. All coil sections extend along corresponding slots cut into sheets 2A, which slots are parallel to common axis 11, and adjacent coil sections are displaced 30° of arc apart from each other around the circumference of structure 3. Moreover, all coil sections are arranged in a sequence around the circumference of structure 3, in which sequence all first coil sections are placed together in order, all second coil sections are placed together in the same order, and so forth.

Continuing with reference to FIG. 6, it can be seen that the magnetic field associated with first coil 4A surrounds first coil section $4A_1$, second coil section $4A_2$, third coil section $4A_3$, and fourth coil section $4A_4$ along the looped path shown by a dashed line. A dotted and dashed line, representing the magnetic field associated with second coil 4B can be seen to have the same shape as the magnetic field shown in association with first coil 4A, but displaced therefrom by 30° of arc. Likewise, the magnetic field associated with third coil 4C has the same shape as the other two fields just described, but is once again displaced therefrom by 30° of arc. When terminals 4′, 4″, and 4‴ are connected to a three-phase AC source, it can be seen that each magnetic field line at any point around common axis 11 is balanced by another field line acting in the reverse direction. Therefore, forces acting between structure 3 and movable reluctor 5 will always cancel out in the radial direction. Therefore, the net radial force acting upon movable reluctor 5 will be zero, so that no vibration can take place in the radial direction and movable reluctor 5 will not come into physical contact with structure 3. As a result of this cancellation of forces in the radial direction, vibration present in prior-art devices is completely eliminated. If the inductance of the invention is changed by moving movable reluctor 5 inwardly and outwardly by rotation of crank handle 8, there will be a net non-zero force acting upon movable reluctor 5 in the axial direction, but this force will be constant and movable reluctor 5 will be fixed in any event. Therefore, this invention is characterized by an absence of vibration regardless of the position of movable reluctor 5.

By constructing frame 1 and movable reluctor 5 in a laminar fashion and by utilizing iron and silicon in each of sheets 2A and discs 5A, magnetic resistivity is held to a minimum. Therefore, heat generation is held to a minimum and efficiency is thereby increased. Moreover, because frame 1 has a large surface area exposed to the atmosphere as a result of the rotation of plates 2 around common axis 11, heat buildup is prevented since any heat generated during operation can be quickly dissapated to the atmosphere.

It will be apparent to those skilled in the art that the material of which sheets 2A and discs 5B are constructed may be changed, as long as frame 1 and movable reluctor 5 are non-conductive and magnetic. Moreover, it will be apparent that any desired number of coil sections can be used as long as they are regularly distributed around the circumference of structure 3. It is not necessary for threaded shaft 6 to threadedly engage discs 5A directly, since an intermediate element such as 6A or 6B may be interposed between threaded shaft 6 and movable reluctor 5 in order to provide the threaded connection therebetween.

It will be understood that each of the elements described above, or two or more together, may also find a useful application in other types of constructions differing from the types described above.

While the invention has been illustrated and described as embodied in a variable three-phase inductor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A variable inductor for use with a three-phase input, comprising:

a frame formed by a plurality of like square plates which are rotated with respect to each other in a single direction about a common axis, each plate having a central hole centered on the axis to define a hollow cylindrical interior volume extending axially through the frame;

a Y network including like first, second and third coils which are each connected at one end to a common point, the Y network being shaped into a hollow, elongated and generally cylindrical structure with an axis and a circumference, in which structure the first, second and third coils extend parallel to the axis and are distributed around the circumference, the structure extending into the interior volume of the frame and being coaxial therewith;

a movable reluctor having an exterior cylindrical shape and an axis, the axis of the reluctor and the axis of the structure being coincident with each other and the reluctor being axially movable into and out of the structure without physical contact therewith; and means attached to the frame and reluctor and moving the reluctor in and out of the structure when the means is operated by a user.

2. The variable inductor defined by claim 1, wherein the reluctor is laminar and includes a plurality of like discs.

3. The variable inductor defined by claim 1, wherein each plate is laminar and includes a plurality of square sheets.

4. The variable inductor defined by claim 2, wherein each disc contains iron and silicon.

5. The variable inductor defined by claim 3, wherein each sheet contains iron and silicon.

6. The variable inductor defined by claim 1, wherein each coil includes a like plurality of coil sections, and wherein each two adjacent coil sections are displaced 30° of arc apart from each other around the circumference.

7. The variable inductor defined by claim 1, wherein each two adjacent plates are rotated 30° of arc with respect to each other.

8. The variable inductor defined by claim 1, wherein the means includes a rotatable threaded shaft extending along the axis of the interior volume and threadedly engaging the reluctor.

* * * * *